US008727401B2

(12) United States Patent
Tanaka et al.

(10) Patent No.: US 8,727,401 B2
(45) Date of Patent: May 20, 2014

(54) INSIDE DOOR HANDLE DEVICE

(75) Inventors: Ryoichi Tanaka, Kanagawa-ken (JP); Yutaka Saitoh, Kanagawa-ken (JP)

(73) Assignee: Alpha Corporation, Yokohama-Shi, Kanagawa-Ken (JP)

( * ) Notice: Subject to any disclaimer, the term of this patent is extended or adjusted under 35 U.S.C. 154(b) by 549 days.

(21) Appl. No.: 13/119,811

(22) PCT Filed: Jan. 7, 2010

(86) PCT No.: PCT/JP2010/050092
§ 371 (c)(1),
(2), (4) Date: Mar. 18, 2011

(87) PCT Pub. No.: WO2010/079800
PCT Pub. Date: Jul. 15, 2010

(65) Prior Publication Data

US 2011/0175377 A1 Jul. 21, 2011

(30) Foreign Application Priority Data

Jan. 9, 2009 (JP) ..... P2009-003379

(51) Int. Cl.
*E05B 3/00* (2006.01)

(52) U.S. Cl.
USPC ..... 292/336.3; 292/348; 292/354

(58) Field of Classification Search
USPC ..... 292/336.3, 348, 354
See application file for complete search history.

(56) References Cited

U.S. PATENT DOCUMENTS

| | | | | |
|---|---|---|---|---|
| 5,011,202 | A * | 4/1991 | Kato et al. | 292/336.3 |
| 5,895,081 | A * | 4/1999 | Tanimoto et al. | 292/348 |
| 6,976,717 | B2 * | 12/2005 | Barr et al. | 292/336.3 |
| 6,988,752 | B2 * | 1/2006 | Belchine et al. | 292/336.3 |
| 8,408,611 | B2 * | 4/2013 | Takagai et al. | 292/336.3 |
| 2005/0134058 | A1 | 6/2005 | Belchine et al. | |
| 2010/0171324 | A1 * | 7/2010 | Stapf | 292/336.3 |
| 2013/0168979 | A1 * | 7/2013 | Minemura | 292/336.3 |
| 2013/0168980 | A1 * | 7/2013 | Minemura | 292/336.3 |

FOREIGN PATENT DOCUMENTS

| | | | |
|---|---|---|---|
| JP | 11-336380 | A | 12/1999 |
| JP | 3138422 | B2 | 12/2000 |
| JP | 2001-207695 | A | 8/2001 |
| JP | 2002-106215 | A | 4/2002 |

* cited by examiner

*Primary Examiner* — Mark Williams
(74) *Attorney, Agent, or Firm* — Nath Goldberg & Meyer; Jerald L. Meyer

(57) ABSTRACT

An inside door handle device includes: a handle base (10) fixed to an inner panel that composes a door interior of an automobile; an opening portion (11) formed of a through hole formed on one side of the handle base (10); an operation recessed portion (12) that has a recessed shape and is arranged adjacent to the opening portion (11) on the other side of the handle base (10); fixation portions (17) formed in the operation recessed portion (12) and fixed to the inner panel; a handle body (20) in which a grip portion (22) located on a tip end side is urged and held onto the operation recessed portion (12) while a base end side is being swingably supported on the opening portion (11) with handle support portions (14*a*) interposed therebetween; and a support beam (13) protruded on the opening portion (11) and formed into a fixed-fixed beam shape bent into an L-shape.

1 Claim, 5 Drawing Sheets

INSIDE DOOR HANDLE DEVICE

This is a National Phase Application filed under 35 U.S.C. 371 as a national stage of PCT/JP2010/050092, filed on Jan. 7, 2010, and claims benefit from Japanese Patent Application No. P2009-003379, filed on Jan. 9. 2009,the entire content of which is hereby incorporated by reference in its entirety.

TECHNICAL FIELD

The present invention relates to an inside door handle device for opening and closing an automobile door from an inside of a vehicle cabin of an automobile.

BACKGROUND ART

As this type of conventional inside door handle device, there is one disclosed in PTL 1. As illustrated in FIGS. 1 and 2, in this conventional inside door handle device 101, a handle body 120 and a lock knob 130 are individually supported on a handle base 110 so as to be freely pivotable. In order to support the handle body 120 and the lock knob 130 on the handle base 110 so as to be freely pivotable, a support beam 113 is formed between the handle body 120 and the lock knob 130. Moreover, on an edge portion of an opening portion 111 of the handle base 110, a cover edge 111*a* that hangs into the opening portion 111 is provided so as to cover and hide a base end portion of the handle body 120 in order that a structure of door interior cannot be seen by a passenger.

CITATION LIST

Patent Literature

PTL1: Japanese Patent No. 3138422 (JP-3138244-B)

SUMMARY OF INVENTION

In general, the handle base 110 is formed by injection molding for injecting resin into a die. However, in the above-described conventional inside door handle device, since the support beam 113 has a cantilever shape, sufficient rigidity has not been able to be ensured. In the case where, in order to ensure the rigidity of the support beam 113, the support beam 113 is extended so as to cross over the opening portion 111, the support beam 113 is formed integrally with the body 120, and the support beam 113 with a fixed-fixed beam shape, in which both ends are supported on the opening portion, is arranged, and at the same time, the cover edge 111*a* is attempted to be provided, then a portion thus extended and the cover edge 111*a* overlap each other in a front-and-back direction. Therefore, only a front-side die and a backside die are insufficient, and a slide die becomes necessary. As a result, a structure of the die becomes complicated, and an increase of manufacturing cost of the inside door handle device is brought about.

In this connection, in the above-described conventional inside door handle device 101, the support beam 113 is formed into the cantilever shape. With such a configuration, it is made possible to compose the die from the front-side die and the backside die. As a result, the manufacturing cost of the inside door handle device can be suppressed.

The handle body 120 is urged and held onto the handle base 110 side by an urging spring (not illustrated), and is always operated at the time of opening and closing the door. Therefore, high rigidity is required for the support beam as a bearing portion. However, in the support beam with the cantilever shape, it has been difficult to sufficiently ensure rigidity on the peripheries of a handle support portion 114*a* and a lock knob support portion 114*b*.

In this connection, it is an object of the present invention to provide an inside door handle device capable of ensuring the sufficient rigidity of a support beam while suppressing manufacturing cost.

In order to achieve the above-described object, an inside door handle device according to a first aspect of the present invention includes: a handle base fixed to an inner panel that composes an inside of an automobile door; an opening portion formed of a through hole formed on one side of the handle base; a support beam that is protruded on the opening portion, and has a fixed-fixed beam shape bent into a substantial L-shape; a pair of handle support portions in which one of the pair of handle support portions is provided on the support beam and the other of the pair of handle support portions is provided on the opening portion; a pair of lock knob support portions in which one of the pair of lock knob support portions is provided on the support beam and the other of the pair of lock knob support portions is provided on the opening portion; a handle body in which a grip portion located on a tip end side is urged and held onto the handle base while a base end side is being swingably supported on the opening portion with the pair of handle support portions interposed therebetween; and a lock knob that is arranged adjacent to the handle body, and has a base end side pivotably supported on the opening portion with the pair of lock knob support portions interposed therebetween. One end of the support beam is protruded along a boundary portion between the handle body and the lock knob in the opening portion, and the other end of the support beam is protruded in parallel to either of an axial direction of the pair of handle support portions or an axial direction of the pair of lock knob support portions in the opening portion.

In accordance with the first aspect of the present invention, the support beam is bent into a substantial L-shape, whereby it becomes possible to compose the die from the front-side die and the backside die even in the case where such a cover edge portion is provided. Hence, an inside door handle device having a support beam with high rigidity can be manufactured without increasing manufacturing cost.

Moreover, the support beam is formed into the fixed-fixed beam shape, whereby rigidity of the peripheries of the handle support portions and the lock knob support portions can be sufficiently ensured.

Furthermore, in the inside door handle device according to the first aspect of the present invention, it is preferable that the other end of the support beam be protruded in the vicinity of such an opening portion-side support portion between the pair of lock knob support portions.

In comparison with an assembled structure of the lock knob, an assembled structure of the handle body is complicated by an amount that the handle body is urged and held onto the operation recessed portion, and in addition, is required to have high rigidity by the amount concerned. However, the other end of the support beam is protruded from the vicinity of the opening portion-side support portion between the lock knob support portions, whereby the rigidity of the peripheries of the handle support portions and the lock knob support portions can be sufficiently ensured without complicating the assembled structure of the handle body.

DESCRIPTION OF EMBODIMENTS

A description is made below of an embodiment of the present invention.

Figure 1:
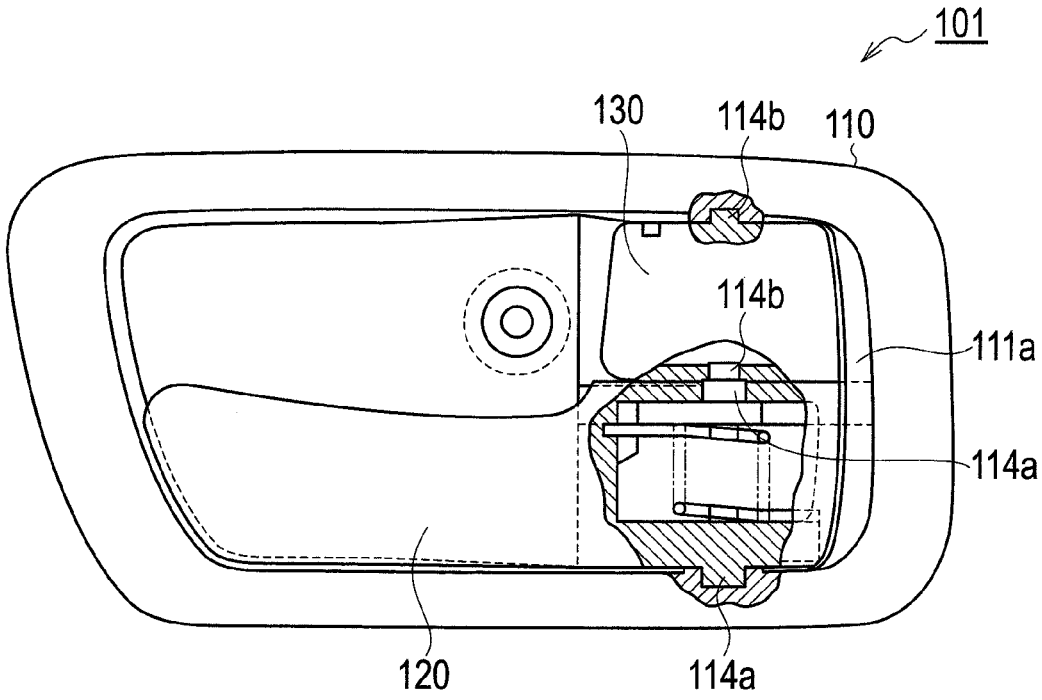
FIG. 1 is a front view illustrating a conventional inside door handle device.
Figure 2:
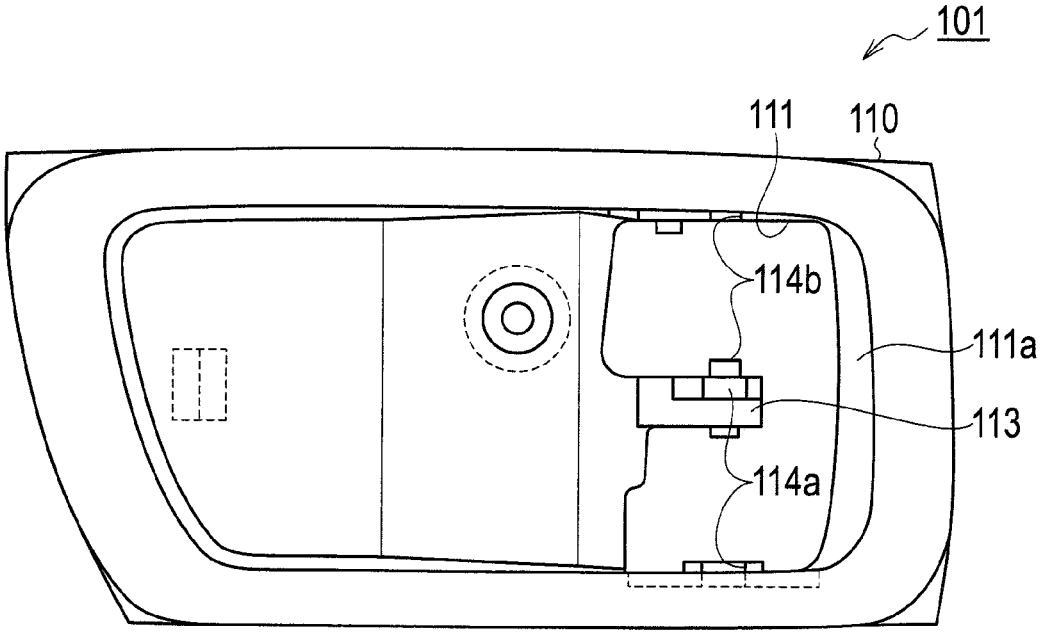
FIG. 2 is a front view illustrating a handle base of the conventional inside door handle device.
Figure 3:
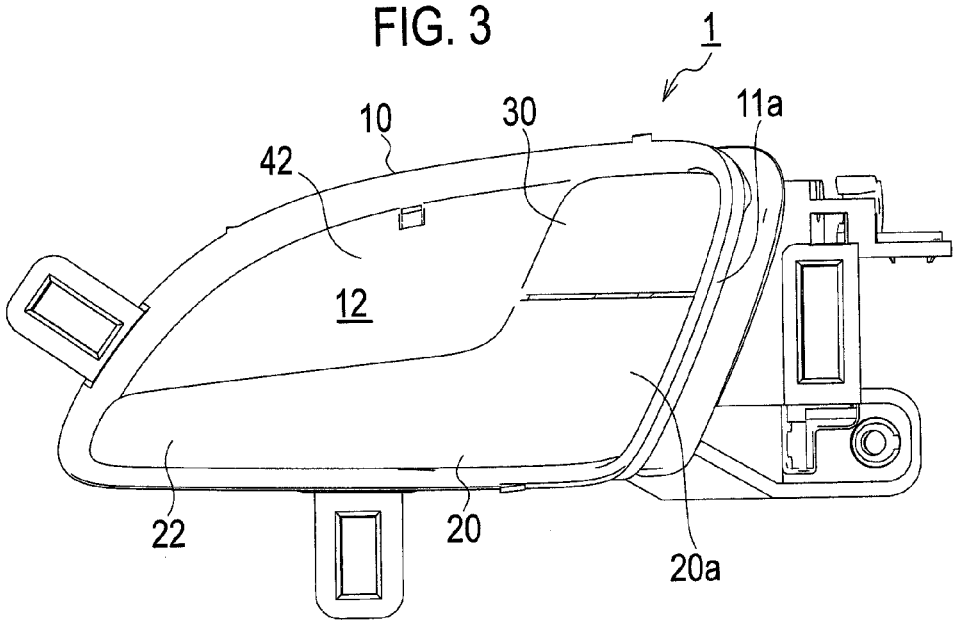
FIG. 3 is a front view illustrating an inside door handle device of an embodiment of the present invention.
Figure 4:
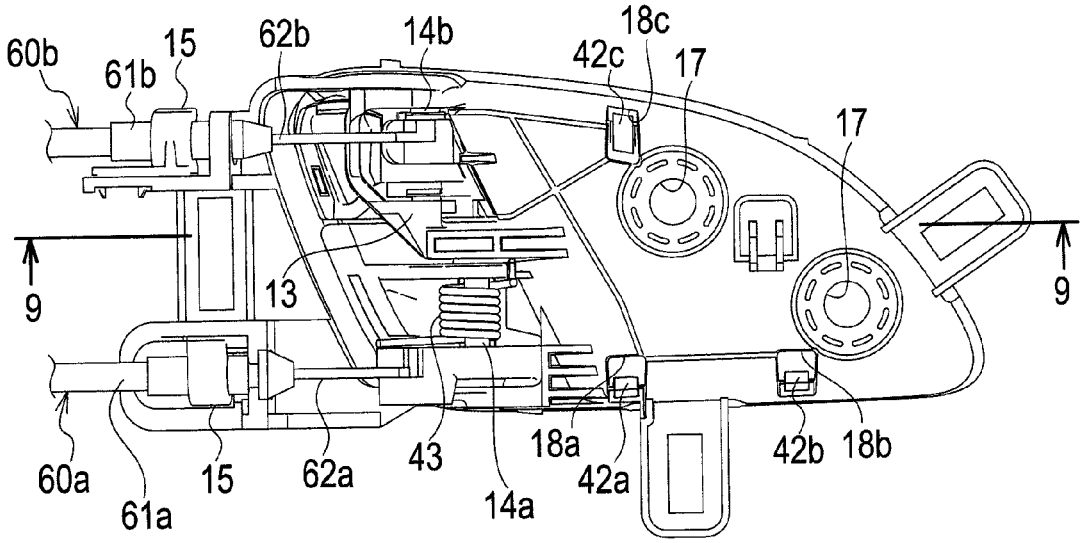
FIG. 4 is back view illustrating the inside door handle device of the embodiment of the present invention.
Figure 5:
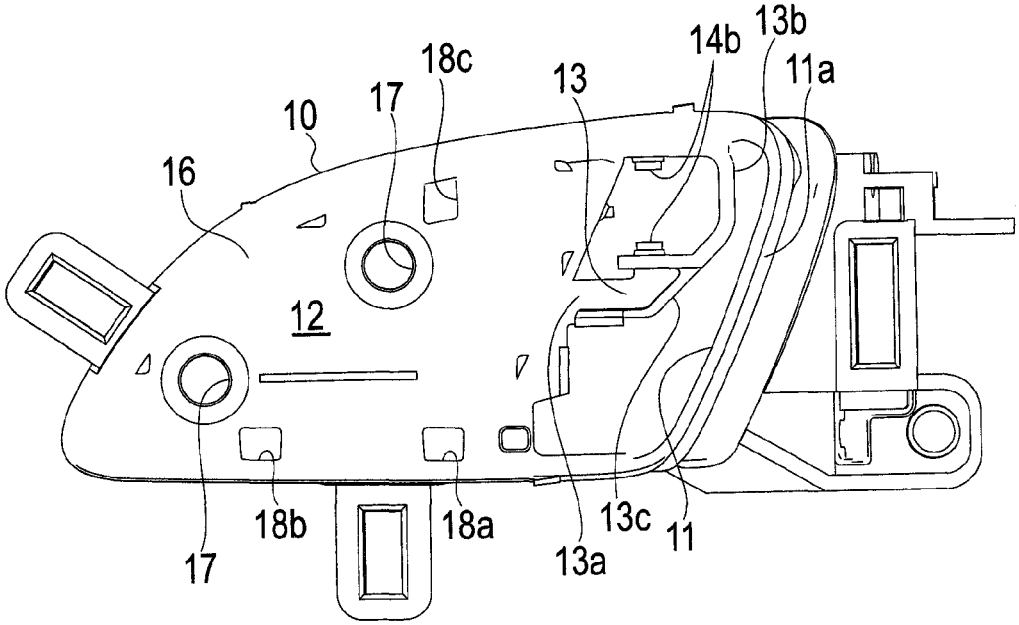
FIG. 5 is a front view illustrating a handle base of the inside door handle device of the embodiment of the present invention.
Figure 6:
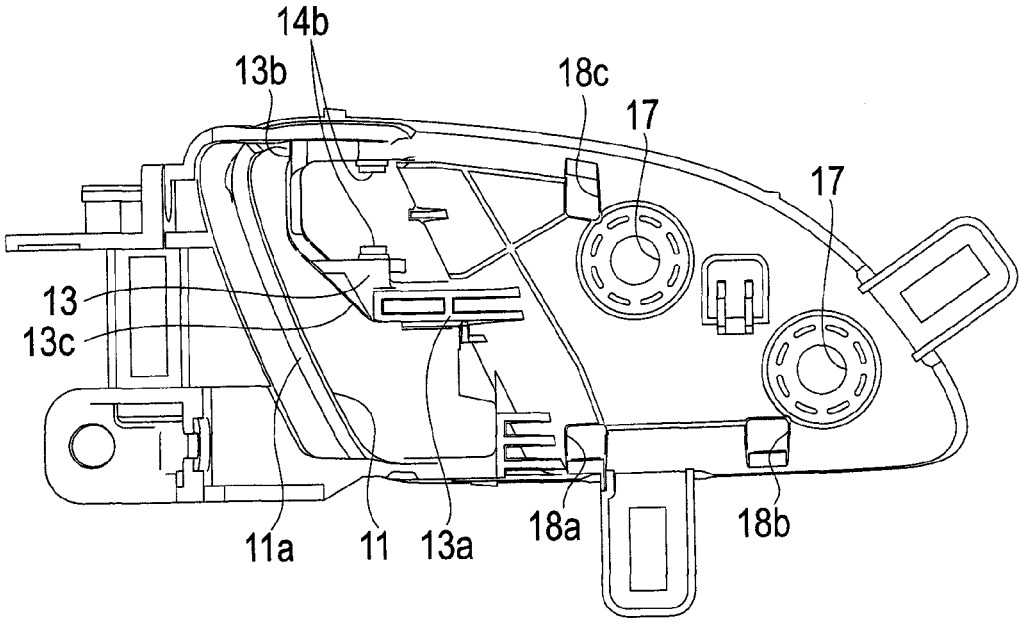
FIG. 6 is a back view illustrating the handle base of the inside door handle device of the embodiment of the present invention.
Figure 7:
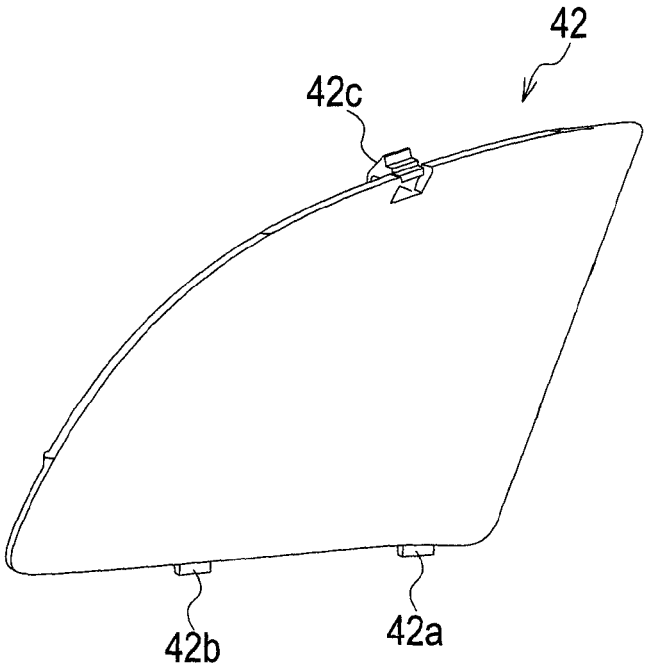
FIG. 7 is a front perspective view illustrating a decorative board of the inside door handle device of the embodiment of the present invention.
Figure 8:
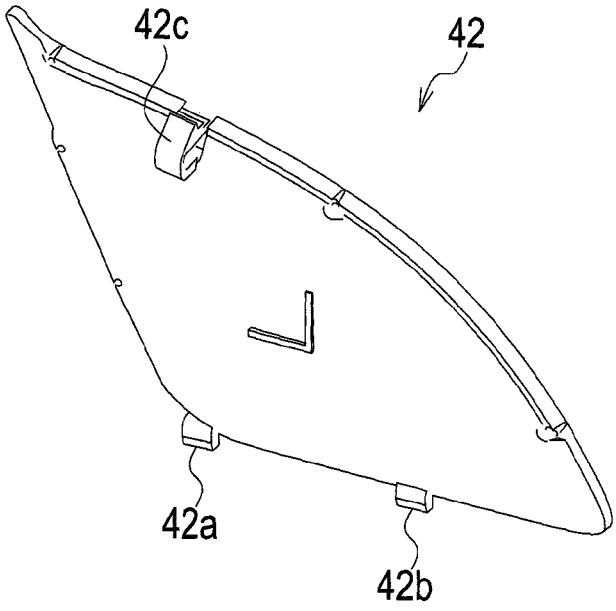
FIG. 8 is a back perspective view illustrating the decorative board of the inside door handle device of the embodiment of the present invention.
Figure 9:
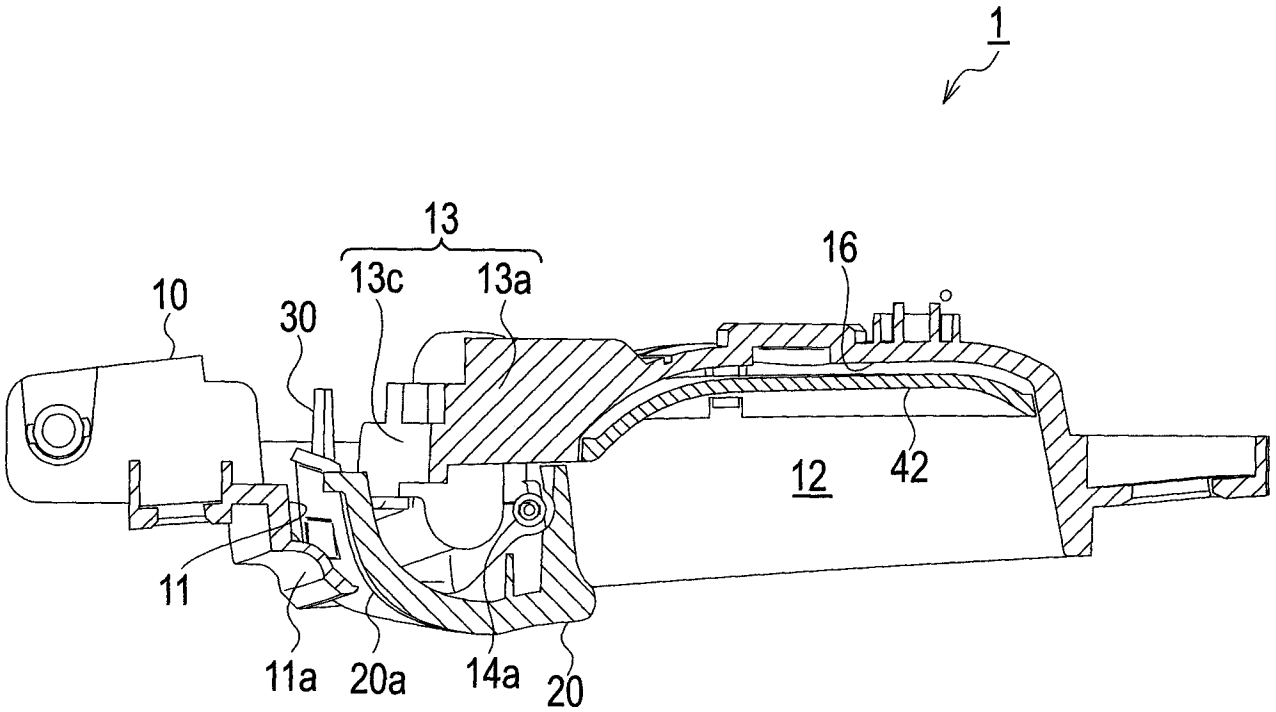
FIG. 9 is a cross-sectional view along a line 9-9 of FIG. 4.

As illustrated in FIGS. 3 to 9, an inside door handle device 1 of the embodiment is mainly composed of: a handle base 10; and a handle body 20 and a lock knob 30, which are supported on the handle base so as to be swingable. Moreover, the inside door handle device 1 is fixed to an inner panel (not illustrated) that composes a vehicle door, and is arranged so as to be exposed from a door trim (not illustrated) facing to an inside of a vehicle cabin. Then, Bowden cables 60 (60*a*, 60*b*) arranged in a door interior are linked with the inside door handle device 1. Note that each of the Bowden cables 60 is composed of: an outer tube 61 (61*a*, 61*b*) having a tubular shape; and an inner wire 62 (62*a*, 62*b*) inserted through inside of the outer tube 61.

The handle base 10 is formed by performing injection molding for a resin material. The handle base 10 includes, on one side thereof, an opening portion 11 formed of a through hole, and includes, on the other side thereof, an operation recessed portion 12 having a recessed shape adjacent to the opening portion 11. Moreover, on an edge portion of the opening portion 11 of the handle base 10, a cover edge 11*a* that covers and hides base end portions of the handle body 20 and the lock knob 30 hangs toward an inside of the opening portion 11 and the operation recessed portion 12 in order that a structure of the door interior cannot be seen by a passenger.

The opening portion 11 is formed into a substantial parallelogram shape in which an upper side gets closer to one side than a lower side. In the opening portion 11, a support beam 13 is formed. The support beam 13 has a fixed-fixed beam shape bent into a substantial L-shape. A pair of handle support portions 14*a* are arranged individually on the support beam 13 and a peripheral edge of the opening portion 11. A pair of lock knob support portions 14*b* are arranged individually on the support beam 13 and the peripheral edge of the opening portion 11. Note that the pair of handle support portions 14*a* and the pair of lock knob support portions 14*b* are arranged in parallel to each other along a vertical direction of the vehicle in a state where the lock knob support portions 14*b* get closer to the one side of the handle base 10 than the handle support portions 14*a*. Moreover, on a one-side end portion of the handle base 10, a set of tube holding portions 15 are provided. Then, end portions of the respective outer tubes 61*a* and 61*b* of the Bowden cable 60*a* for the handle and the Bowden cable 60*b* for the lock knob are held by the tube holding portions 15.

One end 13*a* of the support beam 13 is protruded on a boundary portion between the handle body 20 and the lock knob 30 on an operation recessed portion 12-side peripheral edge in the opening portion 11 so as to go along such a boundary. Moreover, more on the operation recessed portion 12 side than a tip end of the cover edge 11*a* of the opening portion 11, the other end 13*b* of the support beam 13 is protruded in parallel to an axial direction of the lock knob support portions 14*b* in the vicinity of the opening portion 11-side support portion between the lock knob support portions 14*b*. Note that the one end 13*a* and other end 13*b* of the support beam 13 are joined to each other by a coupling portion 13*c* to be diagonally coupled to both of the one end 13*a* and the other end 13*b*.

With such a configuration, at the time of operating the handle body 20, a design surface 20*a* of the base end portion of the handle body 20 is prevented from overlapping the support beam 13, thus making it possible to arrange the support beam 13 without affecting a shape of the design surface 20*a*.

On a bottom surface 16 of the operation recessed portion 12, two fixation portions 17 formed of through holes are provided. Fixing screws (not illustrated) are inserted into the fixation portions 17, and are screwed with the inner panel. As a result, the inner side door handle device 1 is fixed to the inner panel.

Moreover, on the bottom surface 16 of the operation recessed portion 12, three holding holes 18 (18*a*, 18*b* and 18*c*) which penetrate the bottom surface 16 are provided. Two engagement hooks 42*a* and 42*b* provided on a decorative board 42 to be described later are respectively inserted into and engaged with, among these holding holes 18, such first and second engagement/holding holes 18*a* and 18*b* (the first engagement/holding hole 18*a* is located on one side of the operation recessed portion 12, that is, the opening portion 11 side, and the second engagement/holding hole 18*b* is located on the other side of the operation recessed portion 12, that is, a right side in FIGS. 4 and 6) located on an upper edge of the bottom surface 16. Moreover, an elastic hook 42*c* provided on the decorative board 42 is inserted into and engaged with such an elastic holding hole 18*c* located downward. As a result, the decorative board 42 is engaged with and arranged on the operation recessed portion 12.

The decorative board 42 is arranged on a front side of the bottom surface 16 of the operation recessed portion 12. Then, by arranging the decorative board 42, the fixing screws which screw the operation recessed portion 12 are covered, and the fixation portions 17 and the fixing screws are prevented from being seen by the passenger.

A handle fulcrum portion provided on a base end side of the handle body 20 is swingably supported on the opening portion 11 of the handle base 10 with the handle support portions 14*a* interposed therebetween. A grip portion 22, which is located on a tip end side of the handle body 20, and is operated when the passenger opens the door, is urged and held onto the operation recessed portion 12 by a coiled spring 43. A handle-side wire holding portion is provided on the base end portion of the handle body 20. An end portion of the inner wire 62*a* of the Bowden cable 60*a* for the handle is coupled to the handle-side wire holding portion.

In a similar way to the handle body 20, a lock knob fulcrum portion provided on a base end side of the lock knob 30 is rotatably supported on the opening portion 11 of the handle base 10 with the lock knob support portions 14*b* interposed therebetween. A lock knob-side wire holding portion is provided on the base end portion of the lock knob 30. An end portion of the inner wire 62*b* of the Bowden cable 60*b* for the lock knob is coupled to the lock knob-side wire holding portion.

In the inside door handle device 1 of the embodiment, in a state of being temporarily fixed to a window hole (not illustrated) provided on the door trim, the Bowden cables 60 are linked with and held on the handle base 10, the handle body 20 and the lock knob 30. Then, the inside door handle device 1 concerned is fixed to the inner panel by the fixing screws, the decorative board 42 is assembled to the operation recessed portion 12, and mounting of the inside door handle device 1 onto the door is completed.

As described above, in the inside door handle device 1 of the embodiment of the present invention, the support beam 13 is bent into the substantial L-shape. With such a configuration, even if the cover edge 11*a* is provided, it becomes possible to compose a die from a front-side die and a backside die. Hence, the inside door handle device 1 can be manufactured without increasing manufacturing cost.

Moreover, the support beam 13 is formed into the fixed-fixed beam shape. With such a configuration, the rigidity of the peripheries of the handle support portions 14*a* and the lock knob support portions 14*b* can be sufficiently ensured.

In comparison with an assembled structure of the lock knob 30, an assembled structure of the handle body 20 is complicated by an amount that the handle body 20 is urged and held onto the operation recessed portion 12, and in addition, is required to have high rigidity by the amount concerned. Therefore, the other end 13*b* of the support beam 13 is protruded from the opening portion-side vicinity of one of the pair of lock knob support portions 14*b*. With such a configuration, the rigidity of the peripheries of the handle support portions 14*a* and the lock knob support portions 14*b* can be sufficiently ensured without complicating the assembled structure of the handle body 20.

Moreover, the handle support portions 14*a* are arranged closer to the other side (operation recessed portion 12 side) than the lock knob support portions 14*b*. At the time of operating the handle body 20, there has been an apprehension that the design surface 20*a* of the base end portion of the handle body 20 may overlap the support beam 13. However, the one end 13*a* and other end 13*b* of the support beam 13 are joined to each other by the coupling portion 13*c* to be diagonally coupled to both of the one end 13*a* and the other end 13*b*. With such a configuration, the design surface 20*a* and the support beam 13 are prevented from overlapping each other, thus making it possible to arrange the support beam 13 without affecting the shape of the design surface 20*a*.

Industrial Applicability

An inside door handle device having a support beam with high rigidity can be manufactured without increasing manufacturing cost.

The invention claimed is:

1. An inside door handle device attached to an inner panel that composes an inside of an automobile door, comprising:

a handle base fixed to the inner panel of the automobile door;

an opening portion formed of a through hole formed on one side of the handle base;

an operation recessed portion formed on the other side of the handle base, the operation recessed portion having a recessed shape adjacent to the opening portion;

a support beam that is protruded on the opening portion, the support beam having a fixed-fixed beam shape that is bent into a substantial L-shape;

a pair of handle support portions in which first handle support portions are provided on the support beam and second handle support portions are provided on the opening portion;

a pair of lock knob support portions in which first lock knob support portions are provided on the support beam and second lock knob support portions are provided on the opening portion;

a handle body in which a grip portion located on a tip end side is urged and held onto the operation recessed portion while a base end side is being swingably supported on the opening portion with the pair of handle support portions interposed therebetween;

a lock knob that is arranged adjacent to the handle body, and has a base end side pivotably supported on the opening portion with the pair of lock knob support portions interposed therebetween;

a cover edge provided on an edge portion of the opening portion, the cover edge that covers and hides the base end side of the handle body and the base end side of the lock knob, the cover edge hanging toward an inside of the opening portion and the operation recessed portion, wherein one end of the support beam is protruded on a boundary portion between the handle body and the lock knob on an operation recessed portion-side peripheral edge in the opening portion so as to go along the boundary portion, the other end of the support beam is protruded in parallel to either of an axial direction of the pair of handle support portions or an axial direction of the pair of lock knob support portions in the vicinity of the second lock support portion and the one end and the other end of the support beam are joined to each other by a coupling portion to be diagonally coupled to both of the one end and the other end of the support beam whereby the support beam is supported in the fixed-fixed beam shape that is bent into the substantial L-shape.

* * * * *